US010252296B2

(12) United States Patent
Kojima

(10) Patent No.: US 10,252,296 B2
(45) Date of Patent: Apr. 9, 2019

(54) ULTRASONIC SENSOR

(71) Applicant: Seiko Epson Corporation, Tokyo (JP)

(72) Inventor: Chikara Kojima, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/966,632

(22) Filed: Apr. 30, 2018

(65) Prior Publication Data

US 2018/0243795 A1 Aug. 30, 2018

Related U.S. Application Data

(63) Continuation of application No. 14/641,752, filed on Mar. 9, 2015, now Pat. No. 9,987,663.

(30) Foreign Application Priority Data

Mar. 10, 2014 (JP) ..... 2014-046778
Feb. 26, 2015 (JP) ..... 2015-037069

(51) Int. Cl.
*B06B 1/06* (2006.01)
*G10K 11/00* (2006.01)

(52) U.S. Cl.
CPC ..... *B06B 1/0622* (2013.01); *G10K 11/002* (2013.01)

(58) Field of Classification Search
CPC ..... B06B 1/06; B06B 1/0603; B06B 1/0607; B06B 1/0622; B06B 1/0629
USPC ..... 310/322, 334, 335
See application file for complete search history.

(56) References Cited

U.S. PATENT DOCUMENTS

2006/0043843 A1 3/2006 Sugiura et al.
2007/0040477 A1* 2/2007 Sugiura ..... B06B 1/0629 310/324

FOREIGN PATENT DOCUMENTS

JP 2003-333694 A 11/2003
JP 2006-094459 A 4/2006
JP 2010-164331 A 7/2010
JP 2011-255024 A 12/2011

* cited by examiner

*Primary Examiner* — Derek Rosenau
(74) *Attorney, Agent, or Firm* — Harness, Dickey & Pierce, P.L.C.

(57) ABSTRACT

An ultrasonic sensor includes a substrate in which an opening is formed; a vibration plate that is provided on the substrate so as to block the opening; and a piezoelectric element including a first electrode, a piezoelectric layer, and a second electrode that are stacked on an opposite side of the opening of the vibration plate, in which when a direction in which the first electrode, the piezoelectric layer, and the second electrode are stacked is a Z direction, and a portion that is completely overlapped by the first electrode, the piezoelectric layer, and the second electrode in the Z direction is an active portion, a plurality of active portions are provided so as to face the each opening, and a columnar member is provided between the adjacent active portions.

9 Claims, 7 Drawing Sheets

ULTRASONIC SENSOR

CROSS-REFERENCE TO RELATED APPLICATIONS

This application is a continuation of U.S. patent application Ser. No. 14/641,752, filed Mar. 9, 2015, which claims priority to Japanese Patent Application No. 2014-046778, filed Mar. 10, 2014, and Japanese Patent Application No. 2015-037069, filed Feb. 26, 2015, all of which are hereby expressly incorporated by reference herein in their entireties.

TECHNICAL FIELD

The present invention relates to an ultrasonic sensor.

BACKGROUND ART

In the related art, there is known an ultrasonic sensor including a semiconductor substrate having an opening portion, two layers of electrodes on an insulating film layer formed on the surface of the semiconductor substrate by blocking the opening portion, and a piezoelectric element formed with a PZT ceramics thin layer interposed between the two layers of electrodes (see JP-A-2010-164331).

The efficiency of transmission and reception of the ultrasonic sensor depends on the deformation distribution in the ultrasonic sensor, but if it is desired to cause the deformation in the film thickness direction to be significant, a two-dimensional shape when the ultrasonic sensor is viewed in the film thickness direction may be caused to have a low aspect ratio.

Examples of a structure of the ultrasonic sensor include a structure in which transmission and reception are performed on an opening portion side, and structure in which transmission and reception are performed on an opposite side of an opening portion. In all structures, even if only a shape (shape viewed in film thickness direction, that is, shape in a planar view, and hereinafter, referred to as a "shape") of a piezoelectric element is set to have a low aspect ratio, deformation in the film thickness direction does not become significant. That is, an opening portion and an active portion of a piezoelectric element provided thereon are required to be the same size and shapes having low aspect ratios. However, if the shape of the opening portion is caused to be the same size as the active portion of the piezoelectric element, partitions forming the opening portion inhibit propagation of ultrasonic waves, an efficiency decreases or a size of the opening portion becomes excessively small so that workability becomes worse.

SUMMARY

An advantage of some aspects of the invention is to provide an ultrasonic sensor in which efficiency of transmission and reception is enhanced, or in which an ultrasonic sensor of which mass productivity is excellent by causing deformation of a piezoelectric element in a film thickness direction to be significant, even if an opening portion has a high aspect ratio, or even if the size of the shape of an opening portion is greater than that of an active portion of a piezoelectric element.

According to an aspect of the invention, there is provided an ultrasonic sensor including: a substrate on which an opening portion is formed; a vibration plate that is provided on the substrate so as to block the opening portion; and a piezoelectric element including a first electrode, a piezoelectric layer, and a second electrode that are stacked on an opposite side of the opening portion of the vibration plate, in which when a direction in which the first electrode, the piezoelectric layer, and the second electrode are stacked is set to be a Z direction, and a portion that is completely overlapped by the first electrode, the piezoelectric layer, and the second electrode in the Z direction is set to be an active portion, the plural active portions are provided so as to face the one opening portion, and a suppressing portion that suppresses vibrations of the vibration plate is provided between the adjacent active portions. If the scope of the vibration of the vibration plate is limited by the suppressing portion, the deformation of the piezoelectric element in the film thickness direction in the active portion becomes significant, and the efficiency of transmission and reception can be enhanced. In addition, since the one opening portion is provided for the plural active portions, reflection of the ultrasonic waves can be decreased by the partitions forming the opening portion. Accordingly, it is possible to decrease attenuation of ultrasonic waves caused by interference between ultrasonic waves reflected on the partitions and other ultrasonic waves, so as to cancel a portion of the ultrasonic waves. Accordingly, an ultrasonic sensor having high efficiency of transmission and reception can be obtained. In addition, since one opening portion is provided for plural active portions, the size of the opening portion can be formed to be relatively large, and thus a piezoelectric sensor having excellent mass productivity can be obtained.

It is preferable that the suppressing portion is provided on the piezoelectric element side (opposite side of the opening portion). Accordingly, the suppressing portion can be easily provided.

In addition, it is preferable that a total area of the plural active portions disposed to face the one opening portion in a planar view occupies 60% to 80% of the area of the one opening portion.

In addition, it is preferable that when two directions which are orthogonal to each other and orthogonal to the Z direction are set to be a X direction and a Y direction, the plural active portions are disposed in the X direction and the Y direction to face the one opening portion, and the suppressing portions are provided between the adjacent active portions in the X direction and between the adjacent active portions in the Y direction. According to the configuration, even if many active portions are disposed in one opening portion, the deformation of the piezoelectric element in the film thickness direction can be enhanced. In addition, the attenuation of the ultrasonic waves can be decreased by disposing more active portions in one opening portion. Accordingly, the ultrasonic sensor having more excellent efficiency of transmission and reception can be realized. In addition, an ultrasonic sensor having more excellent mass productivity is realized.

Here, it is preferable that the suppressing portion is provided between the adjacent opening portions. Accordingly, the deformation in the film thickness direction becomes more significant, and an ultrasonic sensor having more excellent efficiency of transmission and reception is realized.

In addition, it is preferable that the suppressing portion includes a metal layer. When wiring is formed on the substrate, the metal layer can be formed of the same material as the wiring and at the same time as the wiring. Accordingly, the suppressing portion can be easily formed.

If it is considered that the metal layer can be formed of the same material as the wiring at the same time of forming the wiring when the wiring is formed on the substrate, it is preferable that the metal layer includes gold. Since gold is highly conductive, if gold is used as a material of the wiring, an ultrasonic sensor having high energy efficiency can be realized.

In addition, it is preferable that the ultrasonic sensor further includes a sealing plate that seals a space in a circumference of the piezoelectric element, and the suppressing portion includes a column portion provided on the sealing plate.

Since the column portion provided in the sealing plate is not influenced by vibrations of the vibration plate, more excellent vibration suppressing effects can be obtained. Accordingly, the ultrasonic sensor having more excellent efficiency of transmission and reception is realized.

In addition, it is preferable that the active portion and the opening portion are both in rectangular shapes in a planar view, the aspect ratio of the opening portion is greater than that of the active portion, and the plural active portions are provided in a longitudinal direction of the opening portion. Even if the opening portion has a high aspect ratio, since the scope of vibrations of the vibration plate is limited by the suppressing portion, the deformation in the film thickness direction in the active portion becomes significant so that efficiency of transmission and reception can be enhanced. In addition, the "rectangular shape" includes square shapes. In addition, the "rectangular shape" may not be a perfect rectangular shape, and includes substantially rectangular shapes of which corners may be rounded, or sides may be uneven.

DESCRIPTION OF EMBODIMENTS

Hereinafter, embodiments of the invention are described with reference to the drawings. In the descriptions below and the drawings, three spatial axes which are orthogonal to each other are set to be X, Y, and Z axes, and directions parallel to the directions are respectively set to be X, Y, and Z directions. Since the Z direction indicates a direction in which a vibration plate, a first electrode, a piezoelectric layer, and a second electrode are stacked, the Z direction is called a stacking direction Z. In addition, since the Z direction is a film thickness direction of the stacked elements, the Z direction is called the film thickness direction Z. In addition, the X direction is the first direction X, and the Y direction is called the second direction Y. In addition, in all drawings, only a portion of the ultrasonic sensor is partially illustrated.

Embodiment 1

Figure 1:
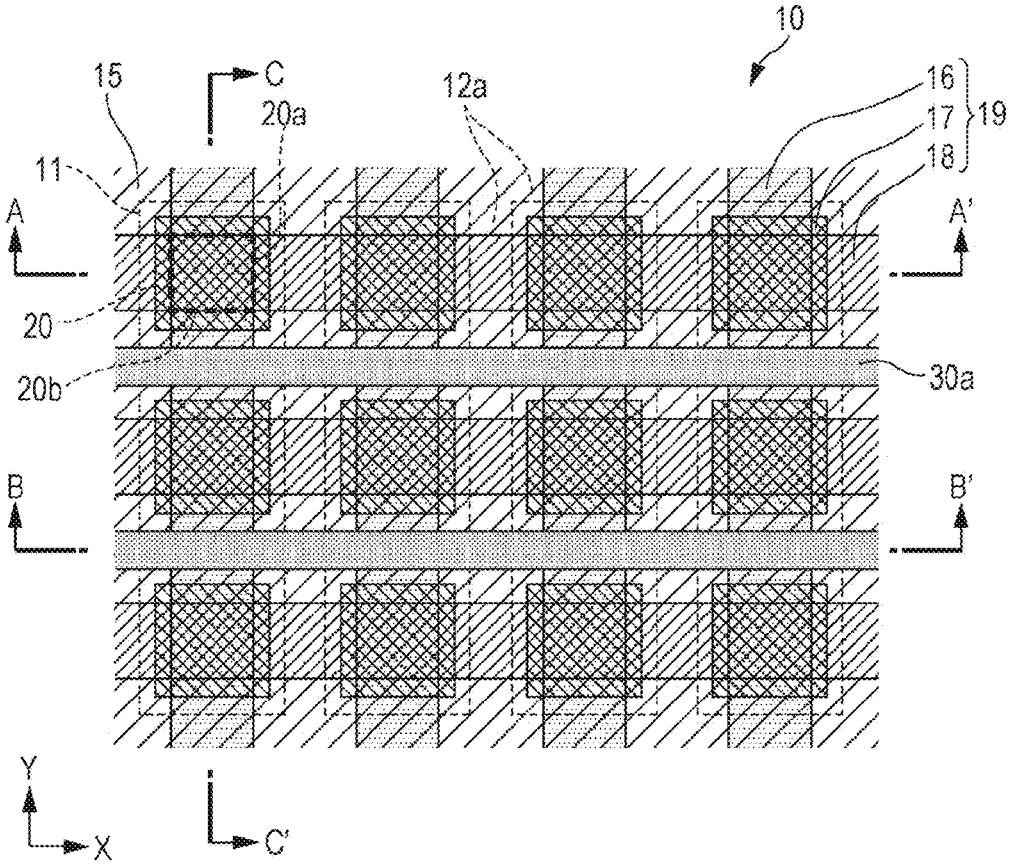
FIG. 1 is a plan view schematically illustrating a configuration of an ultrasonic sensor according to Embodiment 1.
Figure 2:
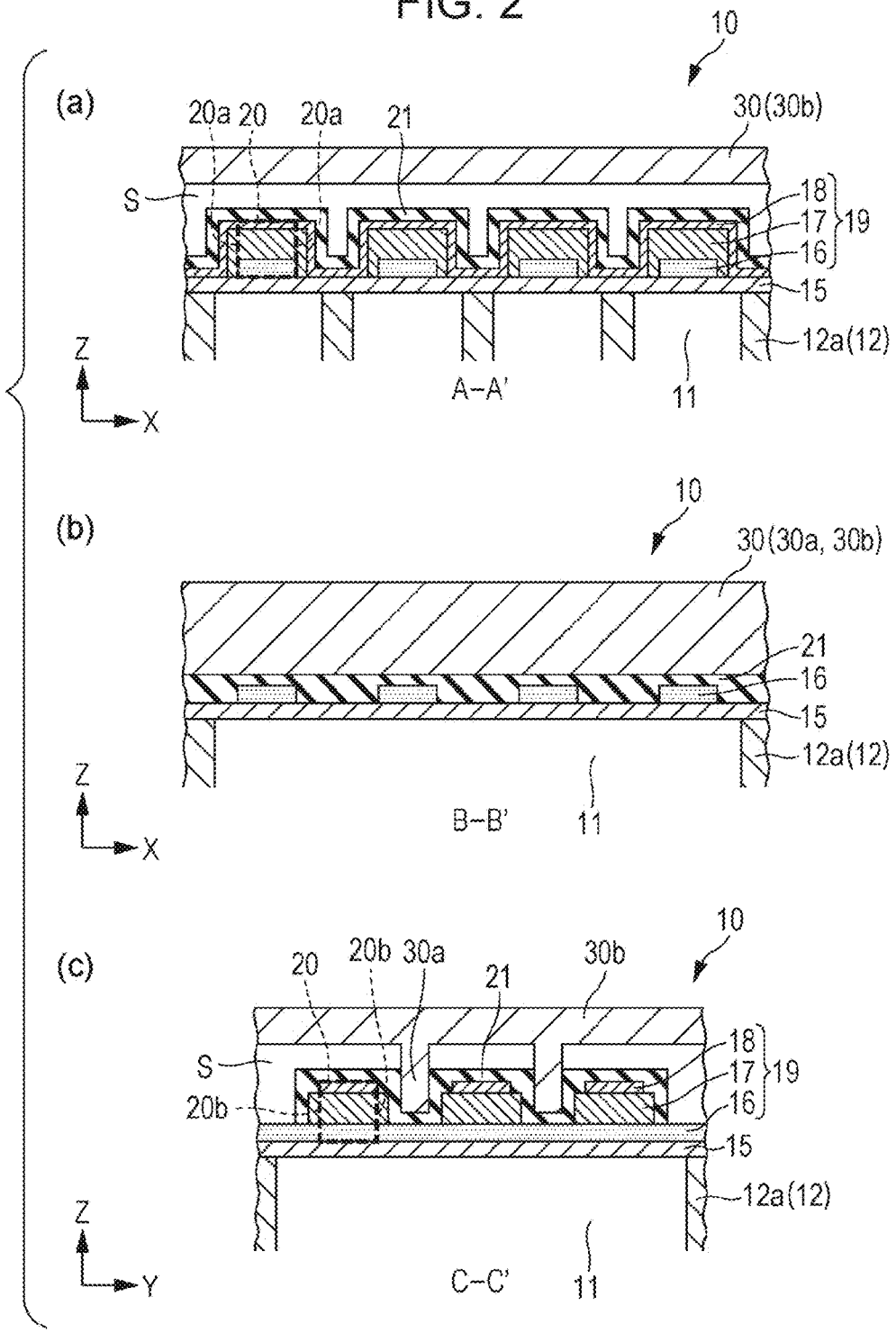
FIG. 2 is a sectional view illustrating the ultrasonic sensor according to Embodiment 1.

FIG. 1 is a plan view schematically illustrating a configuration of an ultrasonic sensor according to Embodiment 1 of the invention, FIG. 2(*a*) is a sectional view taken along line A-A' of FIG. 1, FIG. 2(*b*) is a sectional view taken along line B-B' of FIG. 1, and FIG. 2(*c*) is a sectional view taken along line C-C' of FIG. 1.

As illustrated in FIGS. 2(*a*) to 2(*c*), an ultrasonic sensor 10 of Embodiment 1 includes a substrate 12 on which an opening portion 11 is formed, a vibration plate 15 provided on the substrate 12 blocking the opening portion 11, and a piezoelectric element 19 including a first electrode 16, a piezoelectric layer 17 and a second electrode 18 which are stacked on the opposite side of the opening portion 11 of the vibration plate 15. A portion which is completely overlapped by the first electrode 16, the piezoelectric layer 17, and the second electrode 18 in the film thickness direction Z is called an active portion 20. The substrate 12 is formed of silicon. The substrate 12 includes a partition 12*a* surrounding the opening portion 11. The vibration plate 15 is a stacked body formed with a silicon oxide film and a zirconium oxide. The vibration plate 15 is supported by the partition 12*a* of the substrate 12.

As illustrated in FIG. 1, the opening portion 11 has a form with a high aspect ratio in which a length in the second direction Y is much longer than that in the first direction X, for example, an aspect ratio of 1:70, in the planar view. The active portion 20 of the piezoelectric element 19 has a form with a low aspect ratio in which a length of a side 20*b* in the first direction is similar in length to a length of a side 20*a* in the second direction Y, for example, the aspect ratio of about 1, in the planar view. In view of the significant deformation in the film thickness direction, theoretically, it is most ideal that the aspect ratio of the active portion 20 is 1, but the aspect ratio may be greater than 1. The plural active portions 20 are disposed in one opening portion 11. In Embodiment 1, the three active portions 20 are arranged in one opening portion 11 in the second direction Y. The plural opening portions 11 and the three active portions 20 are arranged in the first direction X and the second direction Y. In FIG. 1, four opening portions 11 are arranged in the first direction X, and one opening portion 11 is arranged in the second direction Y.

The first electrodes 16 extend in the second direction Y, and the plural first electrodes 16 are provided in the first direction X. The second electrode 18 extends in the first direction X, and the plural second electrodes 18 are arranged in the second direction Y. The piezoelectric layers 17 are provided in the first direction X and the second direction Y in a matrix shape.

Materials of the first electrode 16 or the second electrode 18 are not limited as long as the materials are conductive. Examples of the materials of the first electrode 16 or the second electrode 18 include a metallic material such as platinum (Pt), iridium (Ir), gold (Au), aluminum (Al), copper (Cu), titanium (Ti), and stainless steel, a tin oxide conductive material such as indium tin oxide (ITO), and fluorine-doped tin oxide (FTO)), a conductive oxide material such as a zinc oxide-based conductive material, strontium ruthenate ($SrRuO_3$), nickel acid lanthanum ($LaNiO_3$), element-doped strontium titanate, or a conductive polymer.

The piezoelectric layer 17 can typically use a lead zirconate titanate (PZT)-based perovskite structure ($ABO_3$-type structure). According to this, the displacement amount of the piezoelectric element 19 can be easily secured.

In addition, the piezoelectric layer 17 can use a complex oxide in a perovskite structure ($ABO_3$-type structure) without lead. According to this, the ultrasonic sensor 10 can be realized by using a non-lead-based material having less impact on the environment.

Examples of the non-lead-based piezoelectric material include a BFO-based material including bismuth ferrate (BFO; $BiFeO_3$). In BFO, Bi is positioned on an A site, and iron (Fe) is positioned on a B site. Other elements may be added to BFO. For example, at least one element selected from manganese (Mn), aluminum (Al), lanthanum (La), barium (Ba), titanium (Ti), cobalt (Co), cerium (Ce), samarium (Sm), chromium (Cr), potassium (K), lithium (Li), calcium (Ca), strontium (Sr), vanadium (V), niobium (Nb), tantalum (Ta), molybdenum (Mo), tungsten (W), nickel (Ni), zinc (Zn), praseodymium (Pr), neodymium (Nd), and europium (Eu) may be added to KNN.

In addition, other examples of the non-lead-based piezoelectric material include a KNN-based material including potassium sodium niobate (KNN; $KNaNbO_3$). Other elements may be added to KNN. For example, at least one selected from manganese (Mn), lithium (Li), barium (Ba), calcium (Ca), strontium (Sr), zirconium (Zr), titanium (Ti), bismuth (Bi), tantalum (Ta), antimony (Sb), iron (Fe), cobalt (Co), silver (Ag), magnesium (Mg), zinc (Zn), copper (Cu), vanadium (V), chromium (Cr), molybdenum (Mo), tungsten (W), nickel (Ni), aluminum (Al), silicon (Si), lanthanum (La), cerium (Ce), praseodymium (Pr), neodymium (Nd), promethium (Pm), samarium (Sm), and europium (Eu) may be added to KNN.

One which is deviated from a composition of stoichiometry due to excessive deviation, or one in which a portion of the element is substituted to another element is included in a complex oxide of a perovskite structure. That is, as long as the perovskite structure can be achieved, the inevitable deviation of the composition caused by a lattice mismatch, and oxygen deficiency or the like or a partial substitution of an element is acceptable.

If a voltage is applied between the first electrode 16 and the second electrode 18, the piezoelectric element 19 is elastically deformed together with the vibration plate 15, and ultrasonic waves are generated accordingly. Since the deflection of the piezoelectric element 19 is changed according to a configuration material, the thickness, an arrangement position, or a size of the piezoelectric element 19 or the vibration plate 15, the deflection can be appropriately adjusted according to the use and the use mode.

Resonance frequencies unique to respective materials are used, these and frequencies of signal charges applied to the piezoelectric element 19 are caused to be identical or substantially identical, and the piezoelectric element 19 may be deflected by using the resonances.

The first electrodes 16 are patterned in a predetermined width in the first direction X, and are provided in a continuous manner along the plural active portions 20 in the second direction Y. In addition, the second electrodes 18 are provided in a continuous manner along the plural active portions 20 in the first direction X and are patterned within a certain width in the second direction Y. Though not illustrated, the second electrodes 18 are connected to second common electrodes that are derived in the first direction X, and extend in the second direction Y. The active portions 20 are driven by applying a voltage between the first electrode 16 and the second electrode 18. All of the plural active portions 20 may be separately driven, but the active portions 20 are generally divided into several blocks, and the active portions 20 are driven block by block. In addition, in many cases, among the first electrodes 16 and the second electrodes 18, a constant potential is applied to one electrode. Therefore, though not illustrated, wiring for standardizing the first electrodes 16 or the second electrodes 18 or wiring for integrating the wiring is generally provided in each block.

As illustrated in FIGS. 2(*a*) to 2(*c*), for example, an insulation layer 21 formed of alumina or the like is patterned onto the second electrodes 18. Further, a sealing plate 30 sealing the space S around the piezoelectric element 19 is provided on the piezoelectric element 19 side of the substrate 12. The sealing plate 30 includes a column portion 30*a* that suppresses vibrations of the vibration plate 15, a cover portion 30*b* that covers the piezoelectric element 19, and a connecting portion (not illustrated) that is connected to the substrate 12. The space S around the piezoelectric element 19 is sealed by causing the connecting portion of the sealing plate 30 to be connected to the substrate 12. As described below, the column portion 30*a* functions as a suppressing portion that suppresses vibrations of the vibration plate 15. In addition, in FIG. 1, the cover portion 30*b* of the sealing plate 30 and the insulation layer 21 are not illustrated in the drawings, and only the column portion 30*a* is illustrated.

As illustrated in FIGS. 1 and 2(*a*), the partition 12*a* exists between the adjacent active portions 20 in the first direction X. Also, in portions on both outer sides of the sides 20*a* parallel to the second direction Y of the respective active portions 20, the vibration plate 15 is fixed by the partition 12*a* of the substrate 12. Meanwhile, as illustrated in FIGS. 1 and 2(*c*), in the second direction Y, between the adjacent active portions 20, there is a portion in which the partition 12*a* does not exist, and the column portion 30*a* is provided in the portion. Also, in portions on the both outer sides of the side 20*b* parallel to the first direction X of the respective active portions 20, the vibration plate 15 is fixed to the column portion 30*a* provided in the sealing plate 30 or the partition 12*a* of the substrate 12.

Figure 3:
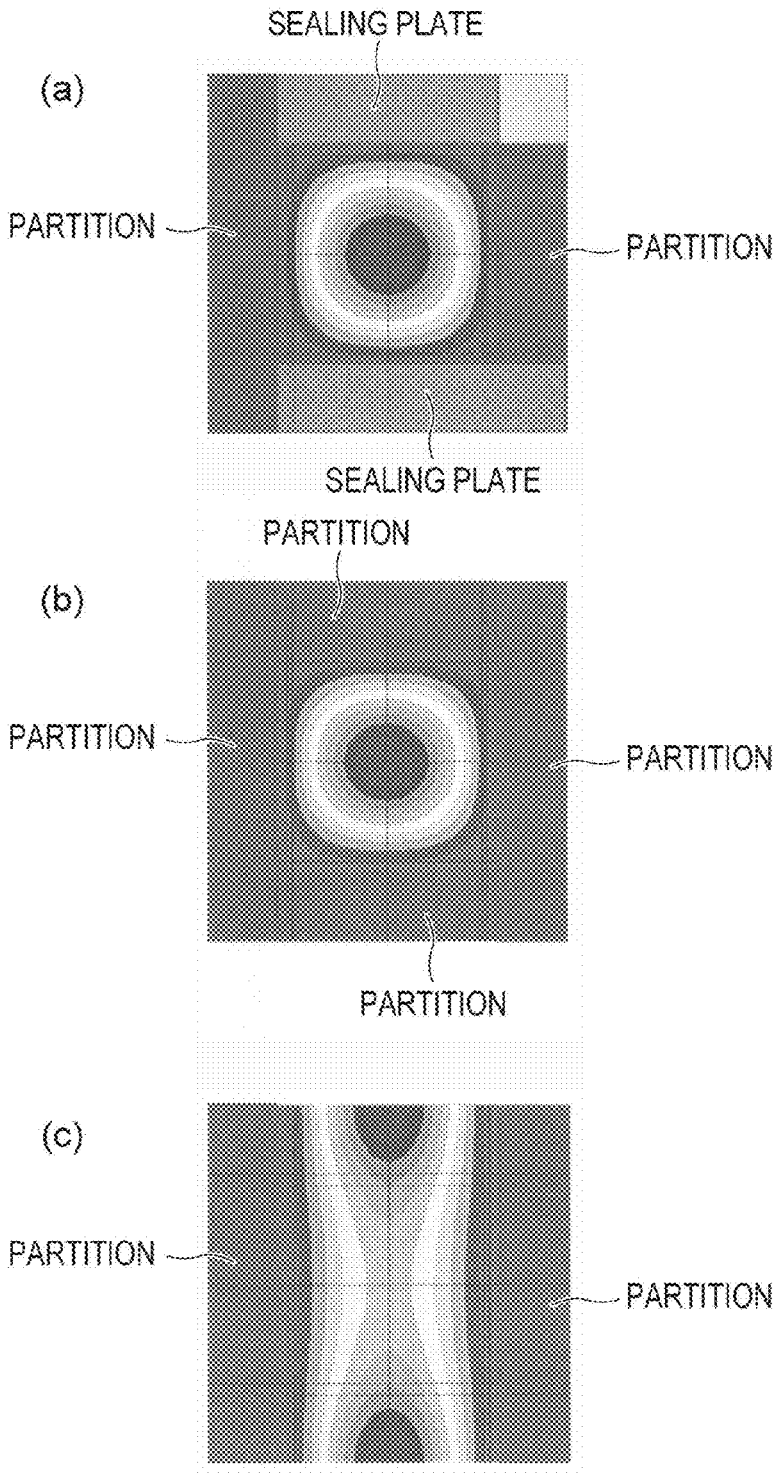
FIG. 3 is a diagram illustrating a displacement profile of the ultrasonic sensor according to Embodiment 1.

If displacement profiles of the active portion 20 and an area in circumferences thereof according to Embodiment 1 are taken, a center of the active portion 20 becomes a center of the displacement as illustrated in FIG. 3(*a*), and thus a significant displacement (deformation in film thickness direction) in the active portion 20 is generated. As illustrated in FIG. 3(*b*), the displacement profile of the active portion 20 is substantially the same as the profile of the opening portion 11 having a shape substantially identical to the active portion 20, that is, a case in which one active portion 20 is provided in one opening portion 11. Meanwhile, when the column portion 30*a* is not provided, the center of the displacement moves to the outer side of the active portion 20 as illustrated in FIG. 3(*c*), and the displacement (deformation of film thickness direction) of the active portion 20 becomes less significant.

As illustrated in FIGS. 3(*a*) to 3(*c*), if there is a portion in which the partition 12*a* does not exist between the adjacent active portions 20, the column portion 30*a* is provided in the portion, and thus vibrations of the vibration plate 15 are suppressed by pressing the vibration plate 15 from the opposite side of the opening portion 11 with respect to the substrate 12. That is, it is known that a vibration scope of the vibration plate 15 is limited by the column portion 30*a*. In addition, according to Embodiment 1, although the opening portion 11 has a high aspect ratio, the same displacement as in the case in which the opening portion has a low aspect ratio can be obtained. Therefore, the effect of suppressing the vibration obtained by the column portion 30*a* is significant.

As described above, according to Embodiment 1, the plural active portions 20 are provided in one opening portion 11. In the first direction X, the partition 12*a* necessarily exists between the adjacent active portions 20, but there is a portion in which the partition 12*a* does not exist between the adjacent active portions 20 in the second direction Y. Accordingly, if measures are not particularly taken, although the active portion 20 has a low aspect ratio, the deformation of the film thickness direction does not become significant. However, according to Embodiment 1, as described above, the column portion 30*a* is provided in the portion in which the partition 12*a* does not exist. Accordingly, the scope in which the vibration plate 15 vibrates is limited by the partition 12*a* and the column portion 30*a*. Accordingly, the deformation in the film thickness direction is enhanced, and the sensitivity at the time of transmitting or receiving signals is enhanced. In addition, according to Embodiment 1, since there is a portion in which the partition 12*a* does not exist between the adjacent active portions 20, inhibition of propagation of ultrasonic waves by the partition 12*a* can be suppressed.

In addition, the opening portion 11 is generally formed by etching the substrate 12. If a size (size in X direction and Y direction) of the opening portion 11 is small with respect to a thickness of the substrate 12, etching may become difficult. According to Embodiment 1, since one opening portion 11 may be formed for the plural active portions 20, the size of the opening portion 11 can be caused to be comparatively greater so that mass productivity can be enhanced.

According to Embodiment 1, the column portion 30*a* is provided in the sealing plate 30, but the column portion 30*a* may be separated from the sealing plate 30.

Embodiment 2

In Embodiment 1, the column portion 30*a* is provided in the sealing plate 30, but a metal layer 35 may be provided on the substrate 12 (the vibration plate 15) instead of providing the column portion 30*a* in the sealing plate 30, and a suppressing portion may be formed by the metal layer 35. As the material of the metal layer 35, gold, copper, aluminum, or the like can be employed. When wiring is formed on the substrate 12, the metal layer can be formed of the same material as the wiring and at the same time of forming the wiring. Considering that the metal layer can be formed of the same material as the wiring and at the same time of forming the wiring, gold is preferable in view of conductivity.

If the metal layer 35 is provided on the substrate 12 (the vibration plate 15), the corresponding metal layer 35 functions as a weight. Though the effect is more decreased than that in Embodiment 1, the metal layer 35 functions as the suppressing portion in the same manner as in Embodiment 1.

Figure 4:
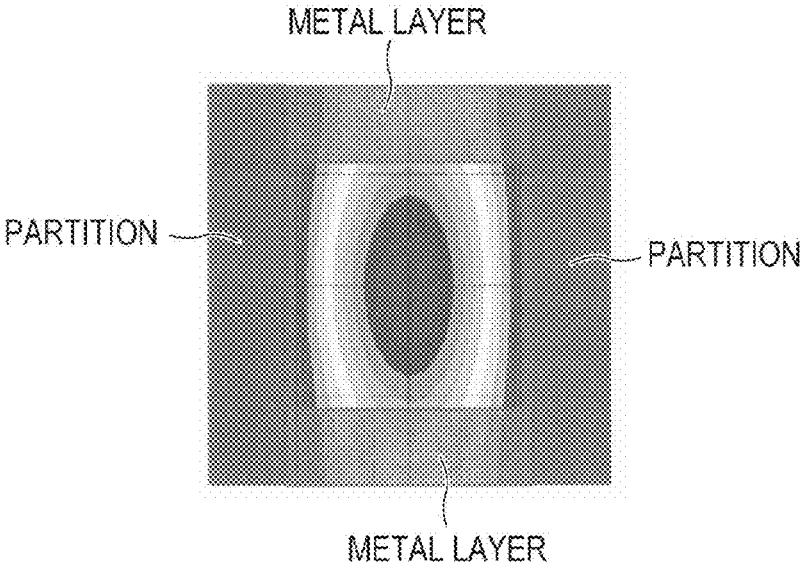
FIG. 4 is a diagram illustrating a displacement profile of an ultrasonic sensor according to Embodiment 2.

Instead of the column portion 30*a* of Embodiment 1, a displacement profile when the metal layer 35 is provided on the substrate 12 is illustrated in FIG. 4. From FIG. 4, it is known that the metal layer 35 has an effect as the suppressing portion. That is, the vibration scope of the vibration plate 15 is limited by the metal layer 35.

In addition, it is considered that the decrease of the effect of Embodiment 2 compared with that in Embodiment 1 is because the metal layer 35 is provided on the substrate 12, and vibrates together with the vibration plate 15. In Embodiment 1, the suppressing portion is formed with the column portion 30*a* provided in the sealing plate 30, the influence of the vibration of the vibration plate 15 is not received, and thus the effect of suppressing the vibration is more excellent.

In addition, Embodiment 2 is different from Embodiment 1 only in that the column portion 30*a* of the sealing plate 30 is changed to the metal layer 35. Other elements can be configured in the same manner as in Embodiment 1. In addition, according to Embodiment 2, the effect of suppressing the vibration is slightly inferior to the effect in Embodiment 1, but the same effect as in Embodiment 1 can be obtained.

Embodiment 3

In the embodiments described above, the ultrasonic sensor 10 includes the opening portions 11 of which the aspect ratio is great, but the size is relatively small. In Embodiment 3, an ultrasonic sensor 10A including opening portions 11A of which the aspect ratio is small, but the size is very large is described.

Figure 5:
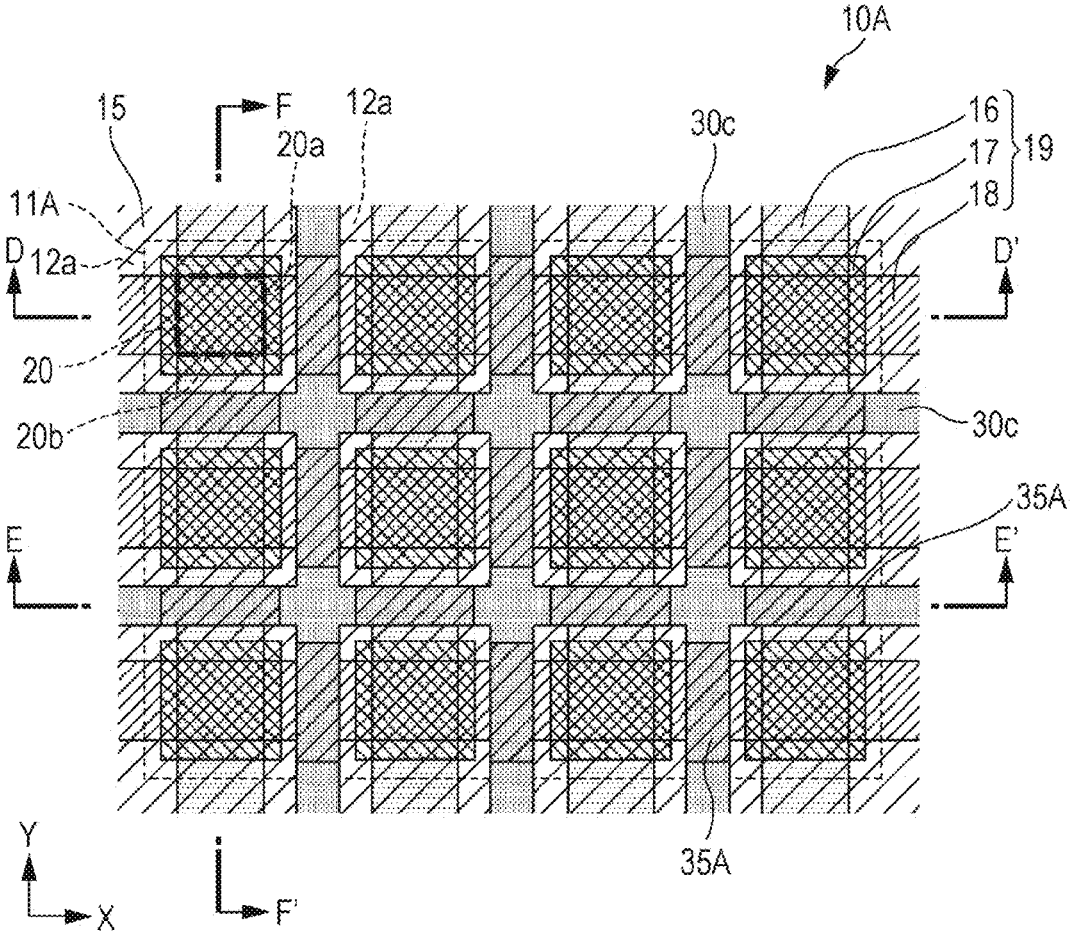
FIG. 5 is a plan view schematically illustrating a configuration of an ultrasonic sensor according to Embodiment 3.
Figure 6:
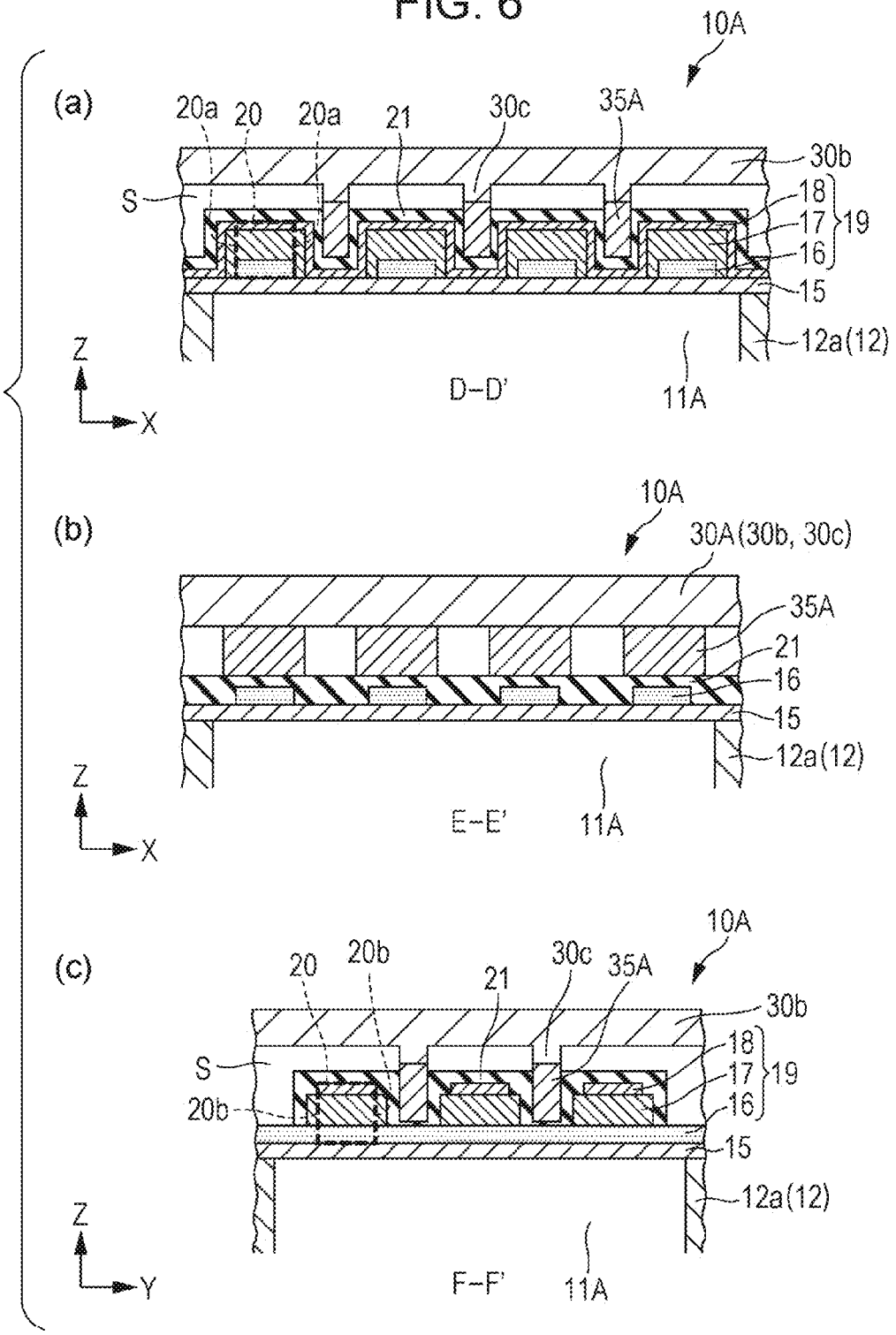
FIG. 6 is a sectional view illustrating the ultrasonic sensor according to Embodiment 3.

FIG. 5 is a plan view schematically illustrating a configuration of an ultrasonic sensor according to Embodiment 3, FIG. 6(*a*) is a sectional view taken along line D-D' of FIG. 5, FIG. 6(*b*) is a sectional view taken along line E-E' of FIG. 5, and FIG. 6(*c*) is a sectional view taken along line F-F' of FIG. 5.

In FIGS. 5 and 6, the same elements as in Embodiment 1 are denoted by the same reference numerals, and the repetitive descriptions are omitted.

As illustrated in FIG. 5, the opening portion 11A has a smaller aspect ratio that the opening portion 11 (FIG. 1) of Embodiment 1 in a planar view. However, the size of the opening portion 11A is much larger than that of the active portion 20, and the twelve active portions 20 are disposed in one opening portion 11A. The twelve active portions 20 are arranged in the X direction and the plural active portions 20 are arranged in the Y direction in the opening portion 11A. The plural opening portions 11A and the twelve active portions 20 are arranged respectively in the first direction X and the second direction Y, but in FIG. 5, only one opening portion 11A is illustrated. As illustrated in FIGS. 6(*a*) to 6(*c*), a sealing plate 30A includes the cover portion 30*b* that covers the piezoelectric element 19, a column portion 30*c* provided on the surface of the cover portion 30*b* in the −Z direction, and a connecting portion (not illustrated) that is connected to the substrate 12. If the connecting portion of the sealing plate 30 is connected to the substrate 12, a space S in the circumference of the piezoelectric element 19 is sealed. In addition, in FIG. 5, the cover portion 30*b* of the sealing plate 30 and the insulation layer 21 are not illustrated, but only the column portion 30*c* is illustrated.

In addition, metal layers 35A are provided between the adjacent active portions 20 on the substrate 12. The metal layers 35A are provided portions of the area facing the column portion 30*c* in the Z direction. The metal layers 35A are provided on outer sides of the sides 20*a* parallel to the second direction Y of the active portions 20 and outer sides of the sides 20*b* parallel to the first direction X.

As illustrated in FIGS. 5 and 6(*a*), in the first direction X, the column portion 30*c* and the metal layers 35A exist between the adjacent active portions 20. In addition, as illustrated in FIGS. 5 and 6(*c*), the column portion 30*c* and the metal layers 35A exist between the adjacent active portions 20 in the second direction Y. The column portion 30*c* and the metal layers 35A cooperate so as to function as suppressing portions in the same manner as the column portion 30*a* of Embodiment 1 and the metal layer 35 of Embodiment 2. That is, in Embodiment 3, the column portion 30*c* and the metal layers 35A are provided between the adjacent active portions 20, and function as suppressing portions.

Figure 7:
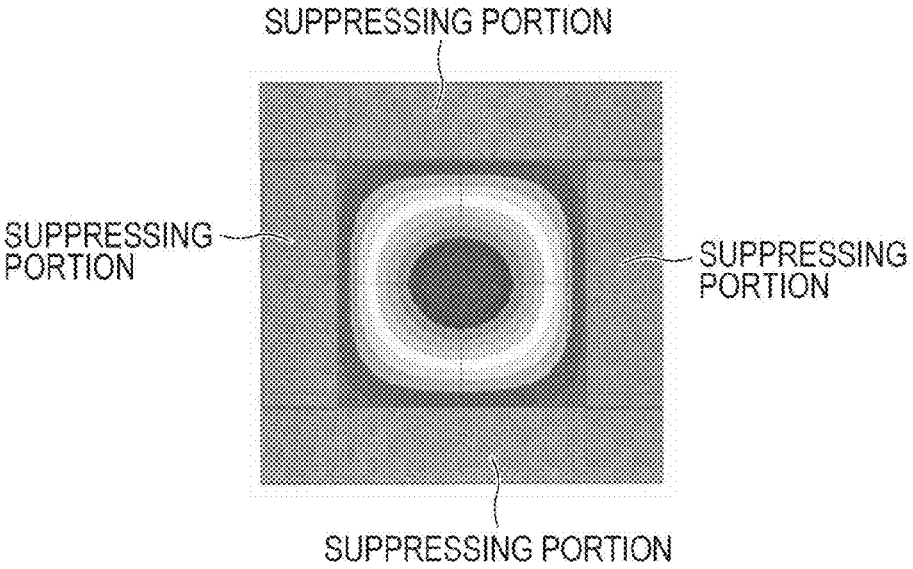
FIG. 7 is a diagram illustrating a displacement profile of the ultrasonic sensor according to Embodiment 3.

A displacement profile of the active portion 20 and the area around the active portion 20 according to Embodiment 3 is illustrated in FIG. 7. As illustrated in FIG. 7, in Embodiment 3, in the substantially same manner as in Embodiment 1 illustrated in FIG. 3(*a*), a significant displacement (deformation in film thickness direction) is generated in the active portion 20. That is, it is known that the vibration scope of the vibration plate 15 is limited by the column portion 30*c* and the metal layers 35A. Accordingly, in Embodiment 3, the same effect as in Embodiment 1 is achieved.

In addition, since there is a portion in which the partition 12*a* does not exist between the adjacent active portions 20 in Embodiment 3, in the same manner as in Embodiment 1, inhibition of propagation of ultrasonic waves by the partition 12*a* can be suppressed, and the ultrasonic sensor 10A having excellent efficiency is realized. In addition, since one opening portion 11A may be formed for the plural active portions 20 also in Embodiment 3, in the same manner as in Embodiment 1, it is possible to cause the size of the opening portion 11A to be relatively large. Therefore, the mass productivity can be enhanced.

Modification Example or the Like

In Embodiment 3, the suppressing portions are formed by the column portion 30*c* provided on the sealing plate 30 and the metal layers 35A provided on the substrate 12, but the suppressing portion may be formed only by the column portion 30*a* provided in the sealing plate 30 in the same manner as in Embodiment 1. In addition, in the same manner as in Embodiment 2, the suppressing portion may be formed only by the metal layer 35 provided on the substrate 12.

In Embodiment 1, the suppressing portion is formed only by the column portion 30*a* provided in the sealing plate, but the suppressing portions may be formed with the column portion 30*c* provided in the sealing plate 30 and the metal layers 35A provided on the substrate 12 in the same manner as in Embodiment 3.

In Embodiments 1 to 3, the total area of the plural active portions 20 disposed to face one opening portion 11 in a planar view preferably occupies 60% to 80% of the area of the one opening portion 11, and more preferably occupies 65% to 75%. The aspect ratio of the active portion 20 is preferably 1.2 to 0.8, and more preferably 1.1 to 0.9. If the total area and the aspect ratio are in the scope described above, the positions and the number of active portions 20 for one opening portion 11 may be arbitrarily determined.

In Embodiments 1 to 3, it is assumed that the active portion 20 and the opening portions 11 and 11A are in a rectangular shape (including square shape) in a planar view, but the shape of the active portion 20 may not be in the rectangular shape. The shape of the active portion 20 may not be a complete rectangular shape. For example, the shape may be a mainly rectangular shape of which corners may be rounded, or sides may be uneven. In addition the shape of the active portion 20 may not be the rectangular shape, and may be a quadrangle other than the rectangular shape, a polygon, a circle, or an oval.

In Embodiments 1 to 3, the suppressing portions (the column portion 30*a*, the metal layer 35, or the column portion 30*c* and the metal layers 35A) are provided only in portions in which the partition 12*a* does not exist between the adjacent active portions 20, and are not provided in portions in which the partition 12*a* exists (between the adjacent opening portions 11 and 11A). However, the suppressing portions may be provided between the adjacent opening portions 11 and 11A.

Others

In the ultrasonic sensors 10 and 10A described above, ultrasonic waves are generated by driving the piezoelectric element 19. There are a configuration in which opposite sides (the opening portions 11 and 11A sides) of the piezoelectric element 19 of the vibration plate 15 become passage areas of ultrasonic waves generated toward a measuring object or ultrasonic waves (echo signals) reflected on a measuring object and a configuration in which the piezoelectric element 19 side becomes a passage area of ultrasonic waves generated toward the measuring object or ultrasonic waves (echo signals) reflected on a measuring object. Embodiments 1 to 3 assume the former configuration. According to this, the configuration on the opposite side of the piezoelectric element 19 of the vibration plate 15 is simplified, and thus satisfactory passage areas of ultrasonic waves or the like can be secured. In addition, electric areas of electrodes or wiring or adhesion and fixation areas of respective members are separated from the measuring object, and thus contamination or leakage currents between the electric areas or the adhesion and fixation areas and the measuring object can be easily prevented.

Accordingly, the ultrasonic sensors 10 and 10A can be satisfactorily used as a pressure sensor mounted in a printer, and can also be satisfactorily used as a medical apparatus that is resistant to contamination or leakage currents such as an ultrasonic diagnosis apparatus, a sphygmomanometer, and a tonometer.

In addition, the opening portion 11 of the substrate 12 is filled with a resin functioning as an acoustic adjustment layer such as silicone oil, a silicone resin, or silicone rubber, and the opening portion 11 is generally sealed with a lens member through which ultrasonic waves or the like can pass. Accordingly, an acoustic impedance difference between the piezoelectric element 19 and the measuring object can be decreased, and ultrasonic waves are effectively generated to the measuring object side.

In addition, as described above, the ultrasonic sensors 10 and 10A employ a configuration in which an opposite side of the piezoelectric element 19 of the vibration plate 15 becomes a passage area of ultrasonic waves generated to the measuring object or echo signals from the measuring object, and thus electric areas of electrodes or wiring or adhesion and fixation areas of respective members are separated from the measuring object, and thus contamination or leakage currents between the electric areas or the adhesion and fixation areas and the measuring object can be easily prevented. Accordingly, the ultrasonic sensors 10 and 10A can be satisfactorily used also as a medical apparatus that is resistant to contamination or leakage currents such as an ultrasonic diagnosis apparatus, a sphygmomanometer, and a tonometer.

Meanwhile, it is assumed that the ultrasonic sensors 10 and 10A described above perform transmission or reception of ultrasonic waves on the opposite side of the piezoelectric element 19 of the vibration plate 15 by driving the piezoelectric element 19, but the invention can be applied also to an ultrasonic sensor that performs transmission and reception on the piezoelectric element 19 side. As described above, also in the ultrasonic sensor that performs transmission and reception on the piezoelectric element 19 side, the suppressing portion (the column portion 30*a*, the metal layer 35, or the column portion 30*c* and the metal layers 35A) is used to suppress the vibration of the vibration plate 15, the vibration scope of the vibration plate 15 is limited, and thus the effect of enhancing the deformation in the film thickness direction can be obtained in the same manner.

What is claimed is:

1. An ultrasonic sensor comprising:

a substrate having at least one opening;

a vibration plate provided on the substrate so as to block the at least one opening; and a piezoelectric element including a first electrode, a piezoelectric layer, and a second electrode that are stacked on an opposite side of the vibration plate than the at least one opening, wherein the first electrode, the piezoelectric layer, and the second electrode are stacked in a Z direction, an active portion of the piezoelectric element is defined by being completely overlapped by the first electrode, the piezoelectric layer, and the second electrode in the Z direction, a plurality of active portions are provided so as to individually face each opening in the substrate, and a columnar member is provided between adjacent active portions.

2. The ultrasonic sensor according to claim 1, wherein the columnar member is provided on a piezoelectric element side of the substrate.

3. The ultrasonic sensor according to claim 1, wherein a total area of the plurality of active portions disposed to face each opening in a plan view occupies 60% to 80% of an area of each opening.

4. The ultrasonic sensor according to claim 1, wherein an X direction and a Y direction are orthogonal to each other and are orthogonal to the Z direction, the plurality of active portions are disposed in the X direction and the Y direction to face each opening, and the columnar member further comprises first columnar members provided between the adjacent active portions in the X direction and second columnar members provided between the adjacent active portions in the Y direction.

5. The ultrasonic sensor according to claim 1, wherein more than one of the at least one opening is provided, and the columnar member is provided between adjacent openings.

6. The ultrasonic sensor according to claim 1, wherein each columnar member faces a metal layer.

7. The ultrasonic sensor according to claim 6, wherein the metal layer includes gold.

8. The ultrasonic sensor according to claim 1, further comprising:

a sealing plate that seals a circumference of the piezoelectric element, wherein the columnar member is provided on the sealing plate.

9. The ultrasonic sensor according to claim 1, wherein each active portion and each opening have a rectangular shape in a plan view, an aspect ratio of each opening in the substrate is greater than that of each active portion, and the plurality of active portions are provided in a longitudinal direction of the opening.

* * * * *